US009501032B2

(12) United States Patent
Kawasaki et al.

(10) Patent No.: US 9,501,032 B2
(45) **Date of Patent: *Nov. 22, 2016**

(54) PROCESS CARTRIDGE HAVING PROJECTED PORTIONS AND RECESSED PORTIONS PROVIDED ON SURFACE OF CHARGING MEMBER AND IMAGE FORMING APPARATUS THEREOF

(71) Applicant: CANON KABUSHIKI KAISHA, Tokyo (JP)

(72) Inventors: Shuhei Kawasaki, Susono (JP); Makoto Tokudome, Yokohama (JP); Daisuke Baba, Mishima (JP); Shun Sato, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/327,896

(22) Filed: Jul. 10, 2014

(65) Prior Publication Data

US 2015/0016843 A1 Jan. 15, 2015

(30) Foreign Application Priority Data

Jul. 11, 2013 (JP) ..... 2013-145136

(51) Int. Cl.
*G03G 15/02* (2006.01)
*G03G 21/18* (2006.01)

(52) U.S. Cl.
CPC ..... *G03G 21/1814* (2013.01); *G03G 15/0233* (2013.01)

(58) Field of Classification Search
CPC ..... G03G 15/0233; G03G 15/0225
USPC ..... 399/176
See application file for complete search history.

(56) References Cited

U.S. PATENT DOCUMENTS 6,798,100 B2 9/2004 Kikuchihara et al.
7,155,137 B2 12/2006 Yasui et al.

(Continued)

FOREIGN PATENT DOCUMENTS

JP 02-139566 5/1990
JP 02-150850 6/1990

(Continued)

OTHER PUBLICATIONS

Dec. 1, 2015 Office Action in Japanese Patent Application No. 2014-138280.

(Continued)

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

A process cartridge detachably mountable to an image forming apparatus includes: an image bearing member for forming a latent image; a charging member, press-contacted to the image bearing member at a predetermined urging force, for electrically charging the image bearing member by being supplied with a charging bias; a developing device for developing the latent image by supplying a polymerized toner to the image bearing member; and a cleaning blade for removing the polymerized toner deposited on the image bearing member in contact with the image bearing member. The charging member includes: an electroconductive support; one or more elastic layer formed around the electroconductive support; and projected portions and recessed portions provided on a surface of the charging member. The projected portions are elastically deformable in contact with the image bearing member, leaving electrically dischargeable gaps between the recessed portions of the charging member and the image bearing member.

18 Claims, 14 Drawing Sheets

(56) References Cited

U.S. PATENT DOCUMENTS

| | | | | |
|---|---|---|---|---|
| 7,257,353 | B2 | 8/2007 | Kawai et al. | |
| 2008/0069618 | A1* | 3/2008 | Ishino et al. | 399/360 |
| 2011/0002711 | A1* | 1/2011 | Wada | 399/176 |
| 2013/0133648 | A1* | 5/2013 | Beach et al. | 128/202.27 |
| 2014/0003845 | A1 | 1/2014 | Tokudome et al. | |
| 2014/0212166 | A1 | 7/2014 | Takeuchi et al. | |
| 2014/0219681 | A1 | 8/2014 | Harada et al. | |

FOREIGN PATENT DOCUMENTS

| | | | |
|---|---|---|---|
| JP | H02-198467 | | 8/1990 |
| JP | H09-043935 | A | 2/1997 |
| JP | 2003-122222 | A | 4/2003 |
| JP | 2003-302809 | | 10/2003 |
| JP | 2004-233818 | | 8/2004 |
| JP | 2007-127163 | A | 2/2007 |
| JP | 2007-078987 | | 3/2007 |
| JP | 2008-015231 | A | 1/2008 |
| JP | 2008-276021 | A | 11/2008 |
| JP | 2013-33244 | A | 2/2013 |

OTHER PUBLICATIONS

Jul. 26, 2016 Office Action in Japanese Patent Application No. 2014-138280.

* cited by examiner

| | Rz (μm) | ASKER C (DEG.) | MD-1 (DEG.) | G (μm) | L(1-P/ES) (μm) |
|---|---|---|---|---|---|
| EMB. 1 | 20 | 64 | 64 | 16 | 18 |
| COMP. EX. 1 | 3 | 43 | 82 | 0. 1 | 0. 28 |
| COMP. EX. 2 | 4 | 50 | 88 | 0. 05 | 0. 11 |
| COMP. EX. 3 | 5 | 56 | 55 | 0. 1 | 0. 16 |
| COMP. EX. 4 | 8 | 56 | 63 | 0. 1 | 0. 18 |
| COMP. EX. 5 | 10 | 57 | 54 | 0. 4 | 0. 53 |
| COMP. EX. 6 | 19 | 57 | 56 | 0. 1 | 0. 16 |
| COMP. EX. 7 | 11 | 57 | 57 | 0. 1 | 0. 12 |
| COMP. EX. 8 | 10 | 57 | 55 | 0. 2 | 0. 28 |
| COMP. EX. 9 | 4 | 66 | 66 | 1. 2 | 1. 31 |
| COMP. EX. 10 | 8 | 66 | 66 | 2. 5 | 2. 58 |

Fig. 5

| | TOTAL DISCHARGE AREA RATIO (%) | INDIVIDUAL DISCHARGE AREA RATIO (%) | STANDARD DEVIATION |
|---|---|---|---|
| EMB. 1 | 48 | 1.9 | 1.75 |
| COMP. EX. 1 | 1 | 0.1 | 0.1 |
| COMP. EX. 2 | 1 | 0.1 | 0.1 |
| COMP. EX. 3 | 2 | 0.1 | 0.1 |
| COMP. EX. 4 | 2 | 0.1 | 0.1 |
| COMP. EX. 5 | 5 | 0.2 | 0.2 |
| COMP. EX. 6 | 3 | 0.1 | 0.1 |
| COMP. EX. 7 | 4 | 0.1 | 0.1 |
| COMP. EX. 8 | 2 | 0.1 | 0.1 |
| COMP. EX. 9 | 2 | 0.1 | 0.1 |
| COMP. EX. 10 | 3 | 0.1 | 0.1 |

Fig. 6

| | ABRASION (μm/k) | CURRENT (μA/mm²) | CLEANING | ROUGHNESS Ra(μm) |
|---|---|---|---|---|
| EMB. 1 | 0. 6 | 1. 1 | O | 0. 046 |
| COMP. EX. 1 | 0. 85 | 1. 51 | × | 0. 12 |
| COMP. EX. 2 | 0. 82 | 0. 7 | × | 0. 115 |
| COMP. EX. 3 | 1. 05 | 0. 62 | × | 0. 225 |

(a)

(b)

| | SLIP-THROUGH | DRUM ABRASION | | WAVI-NESS | TORQUE (%) |
|---|---|---|---|---|---|
| | | Rz(μm) | Sm(μm) | | |
| EMB. 1 | NOT OCCURRED | 0. 35 | 155 | NO | 100 |
| COMP. EX. 1 | AT 3000 SHEETS | 0. 4 | 90 | YES | 140 |
| COMP. EX. 2 | AT 1000 SHEETS | 0. 43 | 88 | YES | 145 |
| COMP. EX. 3 | AT 2500 SHEETS | 0. 37 | 77 | YES | 130 |
| COMP. EX. 4 | AT 3000 SHEETS | 0. 41 | 71 | YES | 120 |
| COMP. EX. 5 | AT 3000 SHEETS | 0. 47 | 59 | YES | 150 |
| COMP. EX. 6 | AT 3000 SHEETS | 0. 48 | 61 | YES | 180 |
| COMP. EX. 7 | AT 2000 SHEETS | 0. 49 | 101 | YES | 170 |
| COMP. EX. 8 | AT 2500 SHEETS | 0. 44 | 70 | YES | 200 |
| COMP. EX. 9 | AT 1500 SHEETS | 0. 51 | 52 | YES | 150 |
| COMP. EX. 10 | AT 2000 SHEETS | 0. 5 | 60 | YES | 170 |

Fig. 15

| | SLIP-THROUGH | IMAGE DEFECT |
|---|---|---|
| EMB. 2 | NOT OCCURRED | NOT OCCURRED |
| COMP. EX. 1 | OCCURRED | AT 2000 SHEETS |
| COMP. EX. 2 | OCCURRED | AT 1000 SHEETS |
| COMP. EX. 3 | OCCURRED | AT 2000 SHEETS |
| COMP. EX. 4 | OCCURRED | AT 2000 SHEETS |
| COMP. EX. 5 | OCCURRED | AT 2500 SHEETS |
| COMP. EX. 6 | OCCURRED | AT 3000 SHEETS |
| COMP. EX. 7 | OCCURRED | AT 3500 SHEETS |
| COMP. EX. 8 | OCCURRED | AT 2500 SHEETS |
| COMP. EX. 9 | OCCURRED | AT 2000 SHEETS |
| COMP. EX. 10 | OCCURRED | AT 2000 SHEETS |

Fig. 16

PROCESS CARTRIDGE HAVING PROJECTED PORTIONS AND RECESSED PORTIONS PROVIDED ON SURFACE OF CHARGING MEMBER AND IMAGE FORMING APPARATUS THEREOF

FIELD OF THE INVENTION AND RELATED ART

The present invention relates to an image forming apparatus for forming an image n a recording medium (medium) and a process cartridge for use with the image forming apparatus.

As a photosensitive member used in the image forming apparatus of an electrophotographic type in recent years, an organic photosensitive member has been used in many cases. As reasons for this, there are (1) optical characteristics such as a broad light absorbing wavelength region and a large absorbing amount, (2) electrical characteristics such as high sensitivity and stable charging characteristic, (3) a wide range of selection of a material, (4) ease of manufacturing, (5) low cost, and the like.

The organic photosensitive member put widely into practical use from these advantages has a surface layer principally containing a low-molecular-weight charge transporting material and an inert polymer, and therefore has a low hardness characteristic in general. For this reason, in the case where the photosensitive member is repeatedly used in an electrophotographic process, due to an electric discharge phenomenon in a charging step, abrasion is liable to occur.

The abrasion of the member (photosensitive drum) generates a deterioration of the electrical characteristic such as a deterioration of the photosensitivity or a lowering in charging property, thus causing a lowering in first density and an abnormal image such as contamination of a background. Further, damage such that the abrasion locally generates has an adverse influence on a cleaning step which is an important step, of an electrophotographic image forming process, for obtaining a clear image. Incidentally, the cleaning step is such a step that a peripheral surface of the photosensitive drum is cleaned by removing a transfer residual toner remaining on the electrophotographic photosensitive member after a transfer step.

In the cleaning step, a cleaning blade is contacted to the electrophotographic member to eliminate a gap between the cleaning blade and the photosensitive drum to prevent passing to the toner through the gap, and scrapes off the transfer residual toner. As a material for the cleaning blade, e.g., a mold of a polymer rubber elastic member such as urethane rubber, chloroprene rubber, ethylene-propylene rubber or nitrile rubber is used in general. In the case where these polymer rubber elastic members are used as the material for the cleaning blade, it has been known that the cleaning blade assumes various types of behavior depending on a surface state of the organic photosensitive member, especially a discharging state of a charging roller.

For example, there is the case where shuddering or turning-up of the cleaning blade is generated. The shuddering of the cleaning blade is a phenomenon that the cleaning blade is vibrated by an increase in frictional resistance between the cleaning blade and the peripheral surface of the photosensitive drum. Further, the turning-up of the cleaning blade is a phenomenon that the cleaning blade is reversed in a movement direction of the photosensitive drum.

Either of the phenomena is generated due to a change in frictional force by an increased friction coefficient caused due to a generation of an electric discharge product when the discharge phenomenon is generated by the charging roller.

As described above, when the behavior of the cleaning blade becomes unstable, cleaning failure such as the passing-through of the toner was generated in some cases. Particularly, in recent years, in order to meet a demand from a market such that an image quality of the image forming apparatus is further improved, a decrease in particle size of the toner and formation of a spherical toner advance. A polymerized toner decreased in particle size and formed in a spherical shape faithfully transfers and moves in response to an electric field and therefore it is possible to develop a high-definition latent image with high reproducibility. Further, this is also true for an electric field in the transfer step, so that the toner image can be transferred at high efficiency.

However, with respect to such a projection, it was difficult to sufficiently clean the surface of the photosensitive drum in a cleaning type using the cleaning blade since the polymerized toner is liable to roll on the photosensitive drum and a depositing force on the photosensitive drum is increased.

As one of conventional methods for suppressing shuddering and turning-up of the cleaning blade, there was a need to stabilize behavior by setting a contact pressure of the cleaning blade at a high value.

However, when the contact pressure of the cleaning blade is set at the high value, a frictional force received by the cleaning blade is increased and therefore a cartridge torque is increased.

As one of the methods for supporting the shuddering and the turning-up of the cleaning blade, the following method has been known. That is, a technique such that a contact area between the cleaning blade and the peripheral surface of the photosensitive drum is decreased by appropriately roughening a smooth surface of the photosensitive drum advance and thus a friction resistance between the cleaning blade and the peripheral surface of the photosensitive drum is decreased is disclosed.

As the technique for roughening the peripheral surface of the photosensitive drum while decreasing the cartridge torque, a technique in which the surface of the photosensitive drum is roughened by abrading the surface of a surface layer by using a film-like abrading material (Japanese Laid-Open Patent Application (JP-A) Hei 02-139566) and a technique for roughening the peripheral surface of the photosensitive drum by blasting (JP-A Hei 02-150850).

In the above-described conventional techniques, there is an effect on solving the problems of the shuddering and the turned-up of the cleaning blade. However, in the case where a minute and spherical polymerized toner is used, by roughening the surface of the photosensitive drum, there is a problem of cleaning failure such that the polymerized toner slips (passes) through between the cleaning blade and the photosensitive drum.

Further, as one of the methods of suppressing the shuddering and the turning-up of the cleaning blade, there is a technique in which a contact portion between the cleaning blade and the photosensitive drum is subjected to hardening (curing) treatment to lower the frictional force.

As an example of the hardening treatment, a cleaning blade prepared by impregnating an elastic blade with a silicon-containing UV curable material and then by irradiating the UV curable material with UV light (beam) to form a cured (hardened) layer at a surface thereof is used (JP-A 2004-233818). In this way, by providing the cured layer, formed from the UV curable material having higher hardness than the elastic blade, it is possible to stabilize behavior of the cleaning blade.

Further, as another method, a cleaning blade prepared by causing a polyurethane resin material, as a base material for a blade member, with an isocyanate compound to form a cured layer at a surface which is a contact portion between the blade member and the image bearing member is used (JP-A 2007-078987).

However, the contact portion of the cleaning blade is subjected to the hardening treatment, and therefore elasticity of the rubber is lowered. For this reason, there was a fear that smoothness is impaired by generation of abrasion non-uniformity, damage and the like at the surface of the photosensitive drum to lower a hermetic contact property between the cleaning blade and the photosensitive drum and thus the polymerized toner slips through a minute gap between the cleaning blade and the photosensitive drum.

Particularly, in the case where an AC charging type is employed as a charging type, compared with a DC charging type, there is an effect of being capable of electrical charging uniformly an object to be charged, but an electric discharge amount is increased. As a result, a discharge current amount per unit area is increased, and therefore there was a problem that an abrasion amount of the photosensitive drum is increased to impair smoothness and therefore cleaning failure is generated.

Further, also in the DC charging type, in the case where a photosensitive drum having a low universal hardness is used, there was a fear that the discharge amount per unit area is increased to impair the smoothness of the photosensitive drum surface and thus the cleaning failure is generated.

As described above, in the conventional techniques, it is not easy to prevent the slip-through particularly of the polymerized toner, decreased in particle size and formed in a spherical shape, by using the cleaning blade without increasing the cartridge torque.

SUMMARY OF THE INVENTION

A principal object of the present invention is to provide a process cartridge and an image forming apparatus, in which a problem of slip (passing)-through of a toner even in the case where a polymerized toner which is not readily removed by a blade is used as the toner.

According to an aspect of the present invention, there is provided a process cartridge detachably mountable to an image forming apparatus, comprising: an image bearing member for forming a latent image; a charging member, press-contacted to the image bearing member at a predetermined urging force, for electrically charging the image bearing member by being supplied with a charging bias; developing means for developing the latent image by supplying a polymerized toner to the image bearing member; and a cleaning blade for removing the polymerized toner deposited on the image bearing member in contact with the image bearing member, wherein the charging member comprises: an electroconductive support; one or more elastic layer formed around the electroconductive support; and projected portions and recessed portions provided on a surface of the charging member, wherein the projected portions are elastically deformable in contact with the image bearing member, leaving electrically dischargeable gaps between the recessed portions of the charging member and the image bearing member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5 is a table showing values including an average roughness Rz, ASKER-C hardness, MD-1 hardness, actually measured air gap and L (1-P/ES) of charging rollers in First Embodiment (Embodiment 1) and Comparison Examples 1 to 10.

FIG. 6 is a table showing values with respect to an area of a discharge portion between the photosensitive drum and the charging roller.

FIG. 15 is a table showing data when a contact state of the cleaning blade in the case where the charging roller in each of First Embodiment (Embodiment 1) and Comparison Examples 1 to 10 is used.

FIG. 16 is a table showing states of slip-through of a toner and image defect in each of Second Embodiment (Embodiment 2) and Comparison Examples 1 to 10.

DESCRIPTION OF THE EMBODIMENTS

Embodiments of the present invention will be described specifically with reference to the drawings.

<First Embodiment>

(Structure of Image Forming Apparatus)

Figure 1:
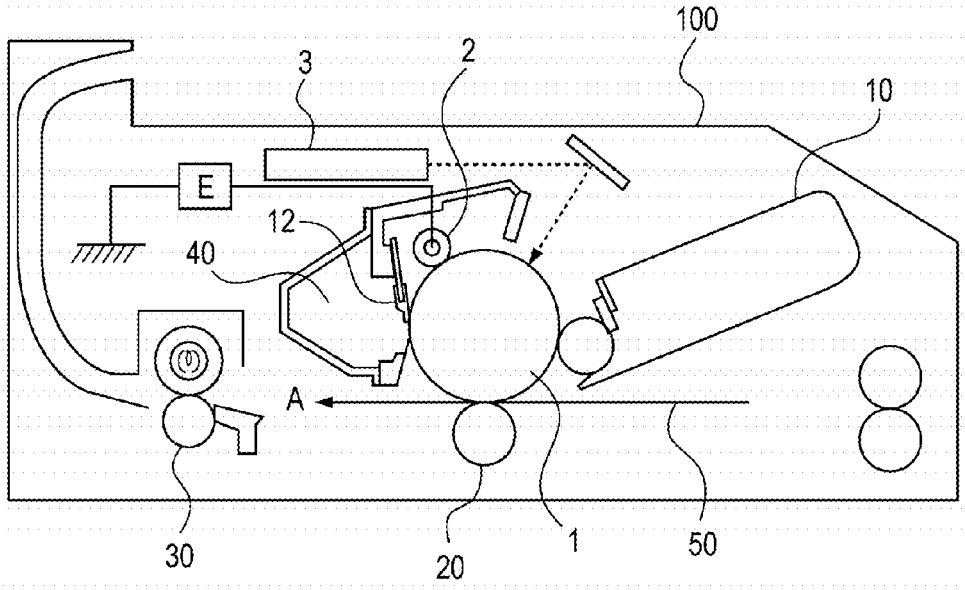
FIG. 1 is a schematic perspective view for illustrating a general structure of an image forming apparatus.

FIG. 1 is a schematic sectional view showing a general structure of an image forming apparatus according to this embodiment.

As shown in FIG. 1, an image forming apparatus 100 includes a rotatable photosensitive drum (image bearing member) 1 for carrying a toner image. The photosensitive drum 1 is constituted data surface portion thereof by an organic photosensitive member. A charging roller 2 electrically charges the surface of the photosensitive drum 1 before formation of a latent image. An exposure device 3 exposes the surface of the photosensitive drum 1 at a charged portion of the photosensitive drum 1 to light, so that the latent image is formed. A developing device 10 supplies a developer to the photosensitive drum 1, thus developing the latent image, formed and carried on the surface of the photosensitive drum 1, with the developer into a visible image. A transfer roller (transfer device) 20 is rotatably supported and transfers the visible image (toner image), formed and carried on the surface of the photosensitive drum 1, onto a sheet-like recording medium (medium) 50, so that an image for fixing is formed. Here, the recording medium 50 is a transfer-receiving material onto which the toner image is to be transferred.

A fixing device 30 subjects the recording medium 50 to fixing, so that the image is fixed and recorded on the recording medium 50. A charging device 40 removes and collects a residual matter on the surface of the photosensitive drum 1 after the transfer and then prepares for next latent image formation.

Further, the photosensitive drum 1, the charging roller 2, the developing device 10 and the cleaning device 40 form a process cartridge as a unit, and this process cartridge is detachably mountable to an apparatus main assembly of the image forming apparatus 100.

Incidentally, in FIG. 1, the recording medium 50 is fed in an arrow A direction, and after being subjected to the transfer and fixing, is discharged to an outside portion of the image forming apparatus main assembly. As the developer (toner), a one-component magnetic developer which is 7 μm in average particle size and 0.97 in average circularity and which is constituted by a styrene-acrylic resin material, a magnetic material and the like is employed. This toner (developer) is a polymerized toner, and the polymerized toner has circularity higher in degree than a pulverized toner and has a shape closer to a sphere. The polymerized toner having the high degree of circularity has an advantage such that a proportion (transfer efficiency) of the toner transferred from the photosensitive drum 1 is higher than that of the pulverized toner. Incidentally, the average circularity of the toner is measured by a measuring device ("FPIA-3000", manufactured by Sysmex Corp.).

Next, an image forming process of the image forming apparatus 100 will be described.

The photosensitive drum 1 is rotationally driven at a predetermined process speed (204 mm/sec). At the surface of the photosensitive drum 1, the charging roller 2 is urged toward the photosensitive drum 1 by an urging spring (not shown) and thus is press-contacted to the surface of the photosensitive drum 1 by a predetermined urging force (pressure) of 500 g-weight.

The charging roller 2 is rotatably held by a bearing member (not shown) at each of end portions of a core metal thereof, and is rotated with rotation of the photosensitive drum 1. Then, a predetermined charging bias is applied from a high-voltage power source E to the charging roller 2 via the core metal, so that the peripheral surface of the rotating photosensitive drum 1 is electrically charged to a predetermined potential. In this embodiment, as a method of applying the charging bias to the charging roller 2, a method in which an AC component is controlled at a constant current is employed. In this method, an AC current passing from the charging roller 2 through the photosensitive drum 1 is detected (not shown) and then is controlled so as to be kept constant. By using this method, a peak-to-peak voltage Vpp of the AC component freely changes depending on change in impedance of the charging roller 2 and the photosensitive drum 1, and therefore it is possible to maintain a discharge current value at a substantially constant level. Specifically, during non-image formation, AC peak-to-peak voltages Vpp at a plurality of levels are applied from an AC oscillation output. Then, the peak-to-peak voltage Vpp at which an AC current Iac passing through the photosensitive drum 1 is not less than a charging AC peak-to-peak voltage selection control threshold current needed so as not to generate improper charging and is minimum is selected as a charging AC peak-to-peak voltage during image formation. Incidentally, a charging frequency f is 1400 Hz in sine wave, and at this time, the photosensitive drum 1 is charged to Vdc=−550 V.

Further, the charged portion of the surface of the photosensitive drum 1 is exposed to laser light from the exposure device 3, so that a latent image having a photosensitive potential Vl=−130 V is formed at the charged portion of the surface of the photosensitive drum 1. The latent image formed and carried on the surface of the photosensitive drum 1 is changed into a visible image in accordance with a reversal developing method.

That is, the developing device 10 supplies the toner (developer) to the photosensitive drum 1, so that the latent image formed on the photosensitive drum 1 is developed into the visible image as a toner image. This visible image (toner image) is transferred onto the recording medium 50 which reaches between the photosensitive drum 1 and the transfer roller 20, so that the image for fixing is formed on the recording medium 50.

Incidentally, the photosensitive drum 1 used in this embodiment is the photosensitive drum of a reversal development type in which an aluminum cylinder of 24 mm in diameter is coated with a 18 μm-thick OPC layer, and an outermost layer thereof is constituted by a charge transporting layer containing modified polycarbonate resin as a binder resin. That is, the photosensitive drum 1 is a drum-shaped (hollow cylindrical) electrophotographic photosensitive member. Further, the photosensitive drum 1 is an image bearing member for bearing (carrying) an image (latent image, toner image) on the surface thereof.

The recording medium 50 on which the image for fixing is carried is subjected to fixing by the fixing device 30, so that the image is fixed and recorded on the recording medium 50. Then, the recording medium 50 subjected to the fixing is discharged to the outside of the image forming apparatus 100.

Incidentally, a residual matter on the surface of the photosensitive drum 1 is removed and collected by the cleaning device, so that the photosensitive drum 1 prepares for next latent image formation.

Incidentally, the cleaning device 40 includes a cleaning blade 12 prepared by fixing urethane rubber to a free end portion of a blade-like metal plate, and the cleaning blade 12 is provided so as to slide on and contact the surface of the photosensitive drum 1 at a contact angle of 24 degrees and a contact pressure of 50 g/cm.

By the cleaning blade 12, the residual matter on the surface of the photosensitive drum 1 after the transfer is removed and then is collected in the cleaning device 40.

Incidentally, in this embodiment, the blade at a contact surface with the photosensitive drum 1 is the urethane rubber blade, but is not limited thereto. The blade may only be required to be formed of a polymer rubber elastic material such as chloroprene rubber, ethylene-propylene rubber or nitrile rubber.

(Structure of Charging Roller)

Then, a structure of the charging roller 2 will be described.

Figure 2:
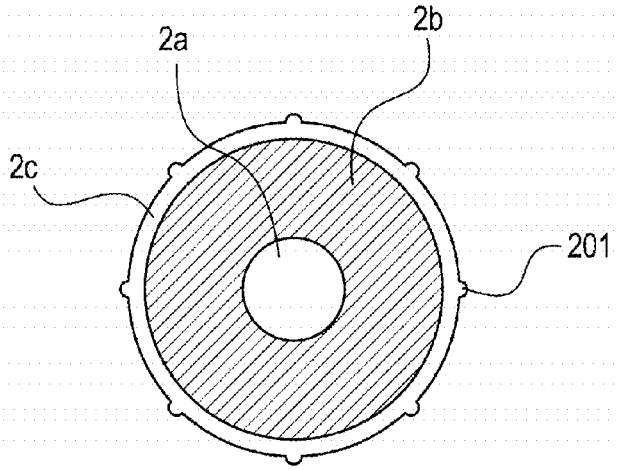
FIG. 2 is a schematic sectional view of a charging roller f the image forming apparatus shown in FIG. 1.

FIG. 2 is a schematic sectional view showing of the charging roller 2.

The charging roller 2 includes a cylindrical electroconductive support 2*a*, an electroconductive elastic layer 2*b* (elastic base layer) formed at an outer peripheral surface of the electroconductive support 2*a*, and a surface layer 2 (elastic surface layer) coating an outer peripheral surface of the electroconductive elastic layer 2*b*. Each of the electroconductive elastic layer 2*b* and the surface layer 2*c* is an elastic layer. For the reason described later, the charging roller 2 may desirably be provided with the surface layer 2*c* at the surface thereof, but it is also possible to use a single layer consisting of the electroconductive elastic layer 2*b* without using the two elastic layers.

The electroconductive elastic layer 2*b* was formed in a roller shape concentrically integral with the electroconductive support 2*a* at the outer peripheral surface of the electroconductive support 2*a* by using a mixture of an electroconductive agent and a polymeric elastic member. As the electroconductive agent, an ion conductive agent such as quaternary ammonium salt or an electron conductive agent such as carbon black is used. Further, as the polymeric elastic member, e.g., epichlorohydrin rubber or acrylonitrile rubber is used.

Thereafter, a thickness of the electroconductive elastic layer 2*b* is adjusted by abrading the electroconductive elastic layer 2*b*, a crown-shaped layer of 10-200 μm in crown amount is formed. In this embodiment, the electroconductive elastic layer 2*b* having the crown amount of 100 μm is used.

(Surface Shape of Charging Roller)

After the electroconductive elastic layer 2*b* is prepared, the surface layer 2*c* is provided as a coating layer. The surface layer 2*c* in this embodiment contains a surface layer binder and fine particles as a surface roughening agent. The fine particles is 10-50 μm, preferably 20-40 μm in volume average particle size and may be either of spherical particles or irregular-shaped particles. Further, the amount of the fine particles contained in the surface layer binder is 10-100 wt. %.

In this way, at the surface of the surface layer 2*c*, a plurality of minute projections (projected portion) 201 are provided. By the minute projections, the surface layer 2*c* has an uneven (projection/recess) portion. A voltage applied between the charging roller 2 and an electroconductive base layer of the photosensitive drum 1 is allocated between an electrostatic capacity C1 of a photosensitive layer (an OPC photosensitive layer of 3 in dielectric constant and 18 μm in thickness) and an electrostatic capacity C2 of a minute air gap G portion formed between the charging roller 2 and the photosensitive layer.

Specifically, each of the electrostatic capacity C1 of the photosensitive layer and the electrostatic capacity C2 of the air layer is, when the distance d is a thickness of the air layer and a unit thereof is μm, represented by the following formula.

$$C1=3\times8.85\times10^{-12}\times1/18\times10^{-6}$$

$$C2=1\times8.85\times10^{-12}\times1/d\times10^{-6}$$

On the other hand, the dielectric breakdown voltage Vz of the minute air layer is represented by the following formula under the atmospheric pressure on the basis of the Paschen's law.

$$Vz=312+6.2\times10^{6}d \text{ (where } 7.7\times10^{-6}m<d)$$

For this reason, there is need to satisfy:

$$((V-312)/6.2)\times10^{-6}m>d.$$

Further, under the atmospheric pressure, when the thickness of the air layer is 7.7 μm or less, the electric discharge is not generated based on the Paschen's law, and therefore when an applied voltage is V (V), a voltage Vair actually applied to the air layer is represented by:

$$Vair=\{C1/(C1+C2)\}\times V.$$

Vair corresponds to a potential difference between the surface of the charging roller 2 and the surface of the photosensitive drum 1.

The electric discharge is generated when Vair≥Vz. Therefore, a voltage of 1000 V is applied, the gap distance d of the dischargeable air gap G is d=7.7 μm to 102 μm, and when a voltage of 2000 V is applied, the gap distance d of the dischargeable air gap G is d=7.7 μm to 265 μm.

That is, the gap distance d during the contact between the photosensitive drum and the charging roller is required to satisfy: $d>7.7\times10^{-6}$ m.

Then, with respect to an air gap G theoretical calculation using various physical property values of the charging roller 2 in this embodiment will be described.

Figure 3:
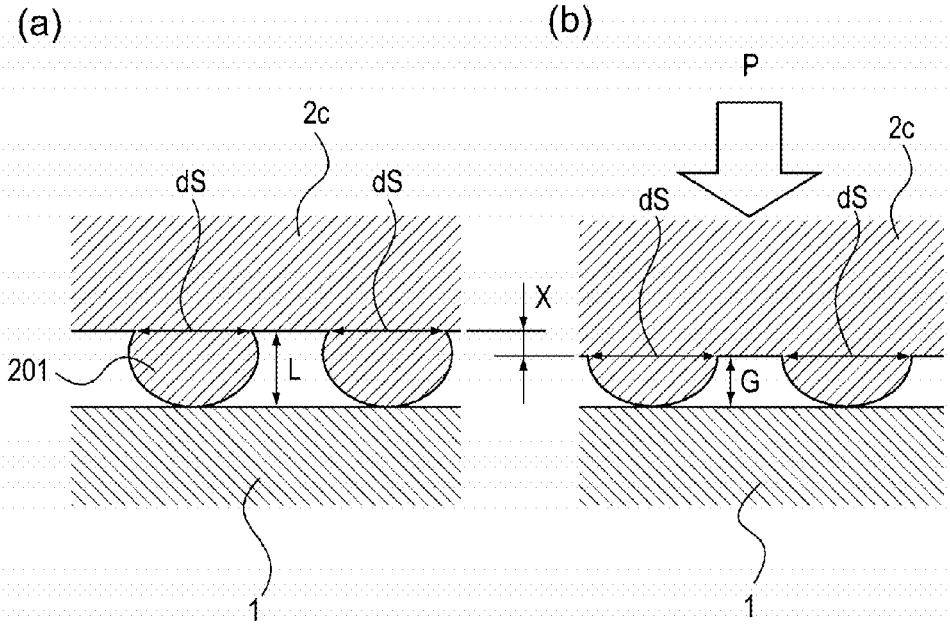
In FIG. 3, (*a*) and (*b*) are schematic enlarged views of a contact portion between the charging roller and a photosensitive drum of the image forming apparatus shown in FIG. 1, in which (*a*) shows a state in which the charging roller contacts the photosensitive drum under no application of pressure, and (*b*) shows a state in which the charging roller is press-contacted to the photosensitive drum under application of pressure (urging force).

In FIG. 3, (*a*) shows a state in which the charging roller 2 is contacted to the photosensitive drum 1 with no pressure, and (*b*) shows a state in which a gap (distance) between the photosensitive drum 1 and the charging member is compressed (decreased).

In this case, assuming that the minute projections 201 are not deformed since the minute projections 201 are formed with high hardness particles, when the gap between the photosensitive drum 1 and the charging roller 2 is compressed, it is possible to consider that the minute projections 201 are burried into the surface layer 2*c* by a rubber characteristic of the surface layer 2*c* of the charging roller 2.

In (*a*) of FIG. 3, a height of the minute projections 201 formed, as a part of the surface layer 2*c*, with the fine particles as the surface roughening agent is taken as L (m). From this state, as shown in (*b*) of FIG. 3, when pressure (urging force) P is applied to the charging roller 2 to press the minute projections 201 into the surface layer 2*c*, a deformation amount in the roller side is taken as X (m).

At this time, the air gap G which is a gap formed between the surface layer 2*c* and the photosensitive drum 1 is represented by the following formula 1.

$$G=L-X \qquad \text{(formula 1)}$$

At this time, when the rubber is regarded as the spring and a distortion (strain) coefficient is Y, based on Hooke's law, the deformation amount X can be represented by the following formula 2.

$$X=YL \quad \text{(formula 2)}$$

This distortion coefficient Y can be represented, based on the Hooke's law when Young's modulus of the charging roller 2 is E (MPa) and stress received by the minute projected portions 201 is Z (N/m), by the following formula 3.

$$Y=Z/E \quad \text{(formula 3)}$$

Further, the stress Z can be represented by a value obtained by dividing pressure P (N), for urging the charging roller 2 against the photosensitive drum 1, by the sum of areas dS each being an area in which the minute projections 201 occupy the surface of the surface layer 2*c*. That is, the stress Z can be represented by the following formula 4.

$$Z=P/\Sigma dS \quad \text{(formula 4)}$$

By using the above-described formulas 1 to 4, the value of the air gap G can be represented by the following formula 5.

$$G=L(1-P/ES) \quad \text{(formula 5)}$$

In the above, S ($m^2$) is ΣdS. That is, in a discharging region between the photosensitive drum 1 and the charging roller 2, the plurality of the minute projections 201 contact the photosensitive drum 1, and therefore the sum of all the contact portions each between the minute projection 201 and the photosensitive drum 1 is S.

When calculation is made by inputting parameters, assuming that L=20 (μm), P=9.8 (N), E=100 (MPa) and S=1 ($\mu m^2$), G=20 (1−(9.8/(64×1))=18 μm holds. Incidentally, the Young's modulus E is measured in a standard environment in which the image forming apparatus is used, and is specifically measured in an environment of 23° C. in temperature and 60% RH in relative humidity.

(Gap Measurement at Contact Portion of Charging Roller)

At the contact surface of the charging roller 2 with the photosensitive drum 1, the air gap G was measured. The air gap G was measured, after the charging roller 2 was left standing for 2 hours or more in the environment of 23° C. and 60% RH, by using a gap measuring machine ("GM1000L", manufactured by Optron Co., Ltd.).

Figure 4:
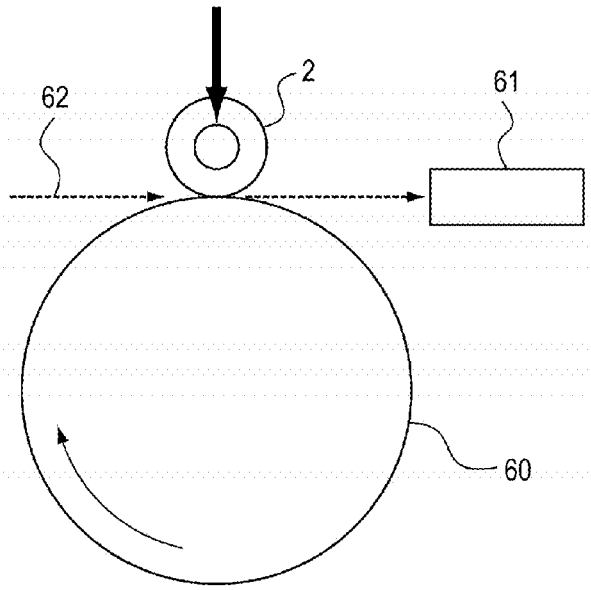
FIG. 4 is a schematic view showing a state in which an air gap of the charging roller shown in FIG. 2 is measured.

FIG. 4 is the schematic view showing a state in which the air gap G is measured.

As shown in FIG. 4, the charging roller 2 was contacted to a matte reference metal roller 60 having a diameter of 50 mm under a load of 9.8 N (1 kg-weight), and then was subjected to laser scanning 62 from a back surface thereof in a state in which the matte reference metal roller 10 was rotated at 0.32 rps. Then, a gap generated between the charging roller 2 and the matte reference metal roller 60 was measured for 3 sec by a detector 61.

A gap height range of the charging roller 2 may preferably be 5-30 μm. In this embodiment, the charging roller 2 is 16 μm in gap height in average.

(Surface Roughness of Charging Roller)

A ten-point average roughness Rzjis of the surface of the charging roller 2 is Rzjis=15-50 μm, preferably Rz=20-30 μm.

In this embodiment, the surface roughness Rzjis of the charging roller 2 was 26 μm.

Incidentally, in this embodiment, the surface roughness Rzjis was measured based on JIS-B0601-2001 by using a surface roughness measuring device ("Surfcoder SE-3500", manufactured by Kosaka Laboratory Ltd.) under a condition of 8.0 mm in measurement length, 0.8 mm in cut-off value, and 0.3 mm/sec in measurement speed.

(Surface Hardness of Charging Roller)

Incidentally, in order to satisfy the formula 1, the surface of the charging roller 2 is required to have hardness in a certain range. When the hardness is excessively low, at the time of contact with the photosensitive drum 1, the minute projections 201 of the charging roller 2 are deformed (collapsed) and thus failing to satisfy the formula 1. Further, there is a possibility such that a depressed trace is generated on the charging roller 2 when the charging roller 2 contacts the photosensitive drum 1. Therefore, in this embodiment, at the surface of the elastic roller 2, the electroconductive elastic layer 2*c* harder and thinner than the electroconductive elastic layer 2*b* is provided.

On the other hand, in the case where the surface of the charging roller 2 is excessively hard, there is a fear such that the photosensitive drum 1 is abraded when contacts the charging roller 2. Therefore, the surface hardness of the charging roller 2 is adjusted by causing the thickness of the electroconductive elastic layer 2*c* to fall within a proper range (by causing the thickness of the electroconductive elastic layer 2*c* not to become excessively large).

From the above viewpoints, Asker C hardness of the surface of the charging roller 2 was suitable when it was 60 degrees or more and 90 degrees or less, preferably 80 degrees or more and 90 degrees or less. In this embodiment, the charging roller 2 having the hardness of the 85 degrees in terms of the Asker C hardness is used.

Incidentally, the Asker C hardness was measured under a constant load, for the Asker C measurement, of 9.8 N (1.0 kgf) at 120-degree pitch positions with respect to a circumferential direction at each of a central portion and left and right portions each spaced from the central portion by 90 mm (i.e., at 9 positions in total) at the surface of the charging roller 2. It was suitable that an MD-1 hardness was 60 degrees to 85 degrees, preferably from 60 degrees to 70 degrees. In this embodiment, the charging roller having the hardness of 64 degrees in terms of the MD-1 hardness is used.

Incidentally, the measurement of the MD-1 hardness was carried out in the following manner. That is, after the charging roller 2 is left standing for 4 hours or more in an environment of 23° C./60% RH, the hardness was measured by a MD-1 micro-rubber hardness meter at 180-degree pitch positions with respect to the circumferential direction at the central portion and left and right portions each spaced from the central portion by 90 mm at the surface of the charging roller 2 (i.e., at 6 positions in total).

(Young's Modulus of Charging Roller)

In this embodiment, the Young's modulus E when a combined layer of the electroconductive elastic layer 2*b* and the surface layer 2*c* is defined as the Young's modulus of the charging roller 2, Young's modulus may preferably be 10-200 MPa.

Incidentally, the Young's modulus was calculated from a distortion amount after a load, of 100 $mN/mm^2$ applied in 1 minute by a universal hardness meter (a surface film physical property testing machine "Fischerscope H100C", manufactured by Fischer Instruments K.K.), reaches 100 $mN/mm^2$. The Young's modulus E of the charging roller used in this embodiment was 20 MPa.

(Resistance of Charging Roller)

The resistance value of the charging roller 2 was $1.0\times10^7$ Ω·cm to $1.0\times10^9$ Ω·cm at 23° C. and 60% RH. In this embodiment, the resistance value was $5.0\times10^7$ Ω·cm.

Incidentally, the resistance value of the charging roller 2 was measured in the following manner. Specifically, the charging roller 2 was, after being left standing for 24 hours or more in the environment of 23° C. and 60% RH, pressed against a mirror-surfaced metal roller, having a diameter of 30 mm, of a current measuring device under a total load of 9.8 N (1.0 kgf) (end portion load of 4.9 N (0.5 kgf) for each of two end portions), and then a PC voltage of 200 V was applied while rotating the mirror-surfaced metal roller at a speed of 30 rpm (while the charging roller 2 is rotated by the metal roller). In this state, the resistance value was measured.

(First Embodiment and Comparison Examples)

FIG. 5 is a table showing values of the surface roughness Rz, the Asker C hardness, the MD-1 hardness, the actually measured air gap G and the value L (1−P/ES) in each of this embodiment (First Embodiment ("EMB. 1")) and Comparison Examples 1 to 10 ("COMP. EX. 1" to "COMP. EX. 10").

As shown in FIG. 5, in this embodiment, the actually measured air gap G is 16 μm, and the value derived by the calculation formula: L(1−P/ES) is 18 μm, so that it is understood that these values are substantially equal to each other. Further, in this embodiment, it is understood that $L(1-P/ES)>7.7\times10^{-6}$ (m) is satisfied.

The charging roller 2 used in this embodiment is surface-roughened largely, and the Young's modulus of the charging roller 2 is adjusted, so that in the case where predetermined pressure is applied at the contact portion of the charging roller 2 with the photosensitive drum 1, a dischargeable gap can be maintained between the charging roller 2 and the photosensitive drum 1.

That is, the minute projections 201 are elastically deformable when being press-contacted to the photosensitive drum 1 by the urging force (pressure), and form dischargeable gaps over a whole area in a press-contact region with the photosensitive drum 1 when the charging bias is applied thereto in the elastically deformed state. By the dischargeable gaps, a charging efficiency of the photosensitive drum 1 by the charging roller 2 is improved. In the following, verification thereof will be made.

(Verification Experiment)

A verification experiment characterizing a discharge state of the image forming apparatus in this embodiment will be described.

(Verification 1: Discharge Trace Observation)

Observation of a discharge trace created on the photosensitive drum 1 by the charging roller 2 in this embodiment was made, and then calculation of a discharge area of the photosensitive drum 1 was performed. In a rest state of the photosensitive drum 1 and the charging roller 2 which were not used and were in a fresh condition in this embodiment, a bias was applied and the photosensitive drum 1 and the charging roller 2 were left standing for 5 minutes. As the applied bias, the superposed oscillating voltage of the same sine wave of Vdc=−550 V, Vpp=1400 V and f=1600 Hz as during the image formation was used.

Then, the area of the discharge trace on the photosensitive drum 1 was measured in the following manner by using an ultra-deep color 3D profile measurement microscope ("YK-9510", manufactured by Keyence Corp.). First, the photosensitive drum 1 as an object to be measured was disposed on a work table, and a tilt angle thereof was adjusted to align a horizontal direction. Then, in a wave mode, three-dimensional profile (configuration) data of the photosensitive drum 1 at a peripheral surface were captured. At that time, observation was made at magnification of 20 for an objective lens.

Then, by using a particle analyzing program in a data analyzing software, a total area of discharge portions was calculated from the sum of areas of the discharge portions which are discriminable as discharge traces on an analyzing screen for the surface of the photosensitive drum 1. Then, from a relational expression: (discharge portion total area/total area)×100(%), an area ratio of the discharge portions was calculated. In the measurement, the total area was 59616 $\mu m^2$.

In any measurement, the measurement was carried out at two or more positions for each of 3 portions consisting of a portion spaced from one end by 5 cm, a central portion and a portion spaced from the other end by 5 cm with respect to a generatrix direction of the cylindrical photosensitive drum 1, and an average of resultant values was a measured value.

FIG. 6 is a table showing values with respect to the discharge area.

The discharge area ratio in this embodiment was 48%, and the discharge area ratios in Comparison Examples 1 to 10 were 5% at the maximum.

Incidentally, in the samples of Comparison Examples 1 to 10, from the above-described calculation result of the Paschen's law, the discharge traces were observed with respect to the charging rollers which should not cause the electric discharge in the contact nip.

It would be considered that there is a possibility that the contact state in the nip is unstable and irregular and therefore electric discharge occurs in a locally microscopic region, and as a result of generation of abnormal electric discharge at the portion, it would be conjectured that the abnormal electric discharge is observed as the discharge trace.

Then, by using the particle analyzing program in the data analyzing software, an individual area ratio of the discharge portions discriminable as the discharge trace on the analyzing screen for the surface of the photosensitive drum 1 was calculated by the relational expression: (discharge portion area/total area)×100(%). Further, standard deviation showing variation in size was calculated.

As shown in FIG. 6, with respect to the charging roller 2 in this embodiment, an average of the individual discharge area per measured area was 1.9%. Further, the standard deviation showing the variation in size was 1.75. Thus, there is a characteristic such that the discharge area fluctuate irregularity.

Figure 7:
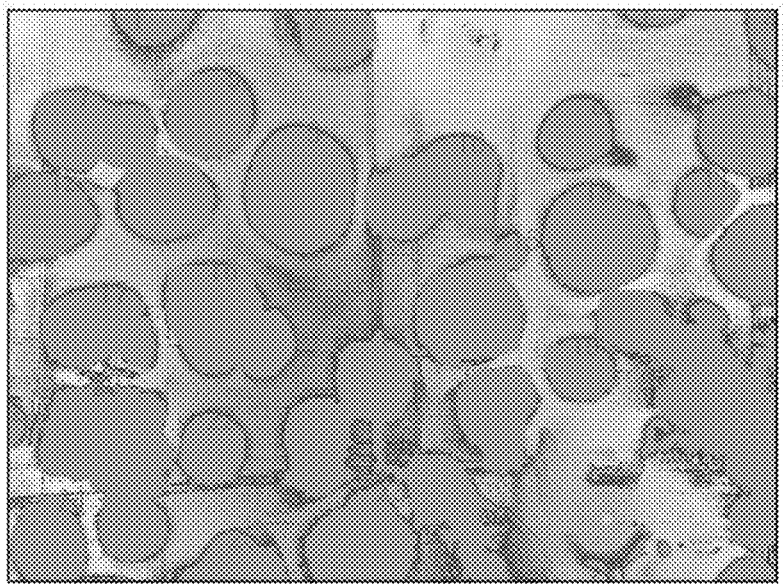
FIG. 7 is an example of an image obtained by processing a peripheral surface of the photosensitive drum so that only a contour portion of the discharge portion can be seen.

FIG. 7 is an example of an image, obtained by observing the peripheral surface of the photosensitive drum 1 created in the verification 1 with the ultra-deep color 3D profile measurement microscope (YK-9510, manufactured by Keyence Corp.) at the magnification of 20 for objective lens, processed so as to be in sight only at contour portions of the discharge portions.

As shown in FIG. 7, only with respect to the charging roller 2 in this embodiment, in the contact nip between the charging roller 2 and the photosensitive drum 1, the generation of the discharge in a wide range was observed.

(Verification 2: VI Characteristic Measurement)

Then, measurement of a discharge amount in the case where the charging roller 2 in this embodiment was used was made.

Figure 8:
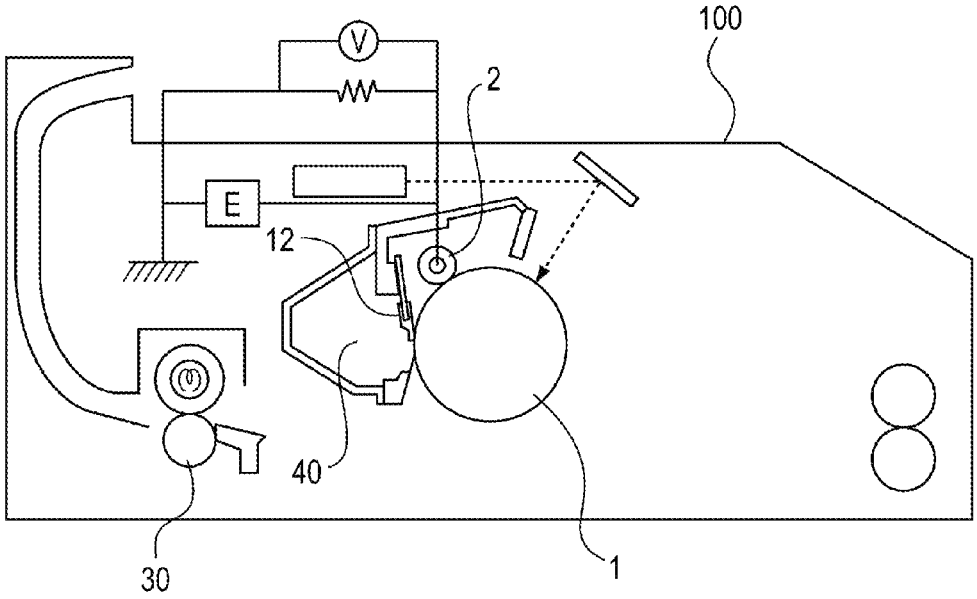
FIG. 8 is a schematic view showing a structure for measuring a discharge amount of the charging roller.

FIG. 8 is a schematic view showing a structure for carrying out the measurement of the discharge amount.

In order to measure a current passing through the photosensitive drum 1 generated by the discharge using the charging roller 2 of the image forming apparatus in this embodiment, in a state in which the developing device 10 and the transfer roller 20 are demounted, the cleaning device 40 is mounted. The reason why the developing device 20 and the transfer roller 20 are demounted is that the developing bias is excited by the photosensitive drum 1 to increase the current and that failure in accurate measurement of a discharge current amount due to the influence of flowing of the transfer current is prevented.

Further, a resistor R of 10 kΩ is placed between the photosensitive drum 1 and a ground for the image forming apparatus, and then a voltage Vac of the resistor R is measured by a voltmeter V. Based on the voltage Vac, a current value I can be obtained from Ohm's law (V=IR).

In actual measurement, the image forming apparatus is driven for 20 sec every measurement, so that the photosensitive drum 1 is rotationally driven. The charging bias is applied for 10 sec which is a period from a lapse of 5 sec to a lapse of 15 sec from start of the rotational drive of the photosensitive drum 1, an average of output values of the voltmeter V during the period was used as a measured voltage.

For each measurement, the charging voltage Vpp was successively changed from 0.1 KV to 2.0 KV with an increment of 0.1 KV. Incidentally, at this time, laser emission is not performed, and therefore the drum potential is −560 V.

Figure 9:
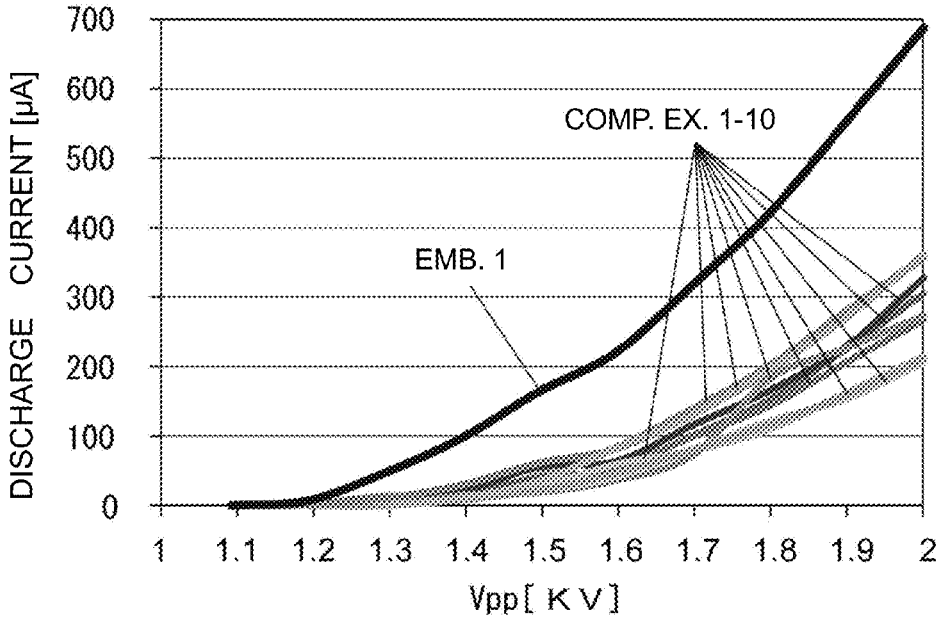
FIG. 9 is a graph showing a relationship between a charging voltage and a discharge current in each of Embodiment 1 and Comparison Examples 1 to 10.

FIG. 9 is a graph showing a relationship between the charging voltage and the discharge current in each of this embodiment (First Embodiment: "EMB. 1") and Comparison Examples 1 to 10 ("COMP. EX. 1" to "COMP. EX. 10").

As shown in FIG. 9, in this embodiment, a high discharge current amount is obtained at a low discharge start voltage. This would be considered because the discharge is generated also in the contact nip as is understood from the result of the verification 1, and therefore the high discharge current amount results from an increase in discharge opportunity with an increase in discharge area. For this reason, in the case where a certain discharge amount is intended to be ensured, in this embodiment, it is possible to suppress the applied voltage to the charging roller at a low level compared with the cases of the charging rollers in Comparison Examples 1-10.

(Verification 3: Charging Fog Characteristic)

A relationship between the discharge current amount of the charging roller 2 and a charging fog image in this embodiment was measured.

Here, the charging fog is a phenomenon such that a charge potential of the photosensitive drum 1 cannot be set at a normal potential due to the improper charging, and thus the latent image is developed with the toner at a portion where the improper charging occurs. In general, such a phenomenon is called a sandpaper-like image since the latent image is developed with the toner in a sandpaper-like shape on a solid white image (which is naturally intended not to generate deposition of the toner). In the following, the charging fog phenomenon is referred to as a sandpaper-like phenomenon.

When the sandpaper-like phenomenon is measured, in the image forming apparatus shown in FIG. 1, the solid white image was formed on sheets at charging voltages Vpp which were changed from 0.1 KV to 2.0 KV with an increment of a 0.1 KV every sheet by the high-voltage power source E of the main assembly E.

Incidentally, the current value at this time was that of the measurement result (FIG. 9) showing the charging voltage Vpp and the discharge current amount in the verification 2 since an accurate transfer current cannot be measured by the influence of the developing bias and the transfer.

In this embodiment, a current value at which the sandpaper-like phenomenon disappeared was 97 (μA).

Figure 10:
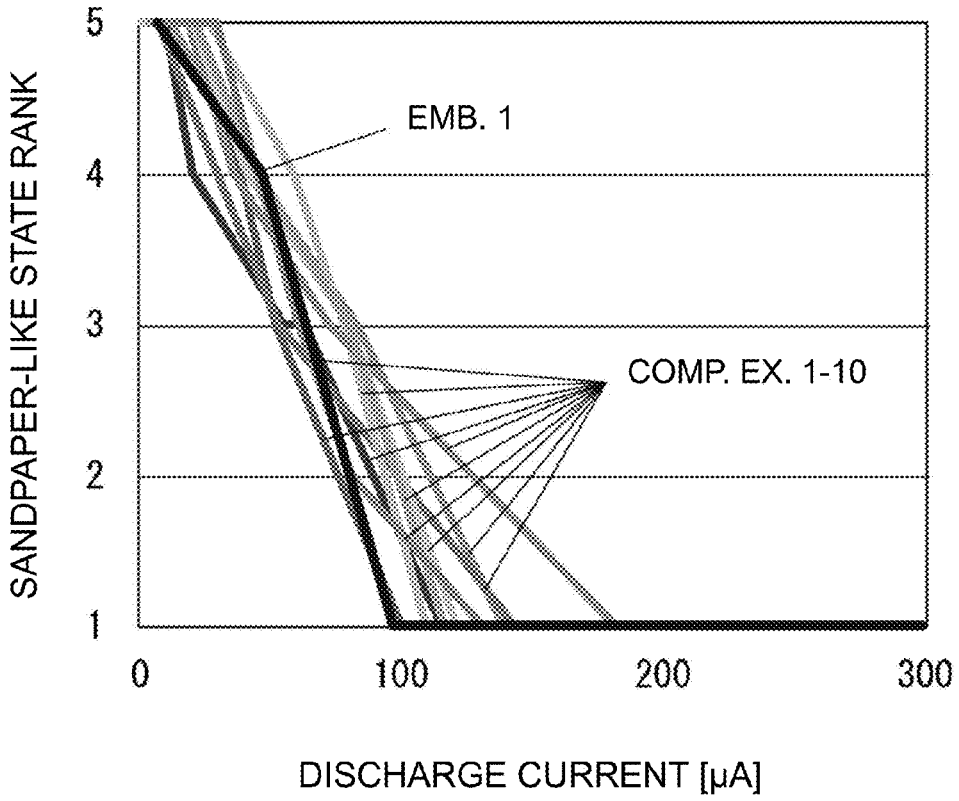
FIG. 10 is a graph showing a relationship between a discharge current of the charging roller and a level of a sandpaper-like phenomenon in each of First Embodiment (Embodiment 1) and Comparison Examples 1 to 10.

FIG. 10 is a graph showing a relationship between the discharge current and a sandpaper-like phenomenon level (sandpaper-like state rank) in each of this embodiment and Comparison Examples 1-10.

In FIG. 10, depending on sandpaper-like image densities of outputted images, the sandpaper-like (image) state was evaluated at 5 ranks as follows.

Rank 1: No sandpaper phenomenon occurred.

Rank 2: The sandpaper-like phenomenon slightly occurred.

Rank 3: The sandpaper-like state corresponds to a density of 0.1 as measured by a reflection densitometer.

Rank 4: The sandpaper-like state corresponds to the density of 0.2.

Rank 5: The sandpaper-like state corresponds to the density of 0.3.

In this embodiment, discrimination of the occurrence of the sandpaper-like phenomenon was made at the time when the rank reaches the rank 2.

From the data of the graph of FIG. 10, it is understood that the state of the sandpaper-like image is improved with the increase in discharge current amount and the sandpaper-like image disappears at the discharge current amount of about 100 μA to about 150 μA (about 100 μA in this embodiment).

As described above, from the results of the verifications 2 and 3, in order to obtain the discharge current amount required for suppression of the sandpaper-like phenomenon, it is understood that a desired discharge current amount can be obtained by applying the charging voltage Vpp of 1.4 KV to the charging roller 2 in this embodiment. On the other hand, in order to suppress the sandpaper-like phenomenon, with respect to the charging rollers in Comparison Examples 1 to 10 regarding the prior art, there was a need to apply the charging voltage Vpp of 1.6 KV or more.

In this way, as a feature of the charging roller 2 in this embodiment, the discharge current amount increases with the increase in discharge opportunity, and therefore the applied voltage necessary to suppress the sandpaper-like image can be made lower than the applied voltage to the charging rollers in the prior art. That is, the charging roller 2 in this embodiment is high in charging performance and is capable of electrically charging the photosensitive drum 1 even when the applied voltage is lowered.

(Verification 4: Nip Width and Discharge Current Amount)

A discharge current amount per unit (discharge) area in each of this embodiment ("E1") and Comparison Examples 1-10 ("CE1" to "CE10") was calculated.

For calculation of the discharge area, a discharge nip width of the charging roller 2 at the discharge current amount at the time when the sandpaper-like phenomenon disappeared was measured by using the ultra-deep color 3D profile measurement microscope (YK-9510) at the magnification of 5 for the objective lens. As a result, an average discharge nip width of the charging roller 2 in this embodiment was 800 μm.

Further, an effective charging width of the charging roller 2 in this embodiment is 226 mm. From this value, the contact area was $0.8\times226=180.8$ mm$^2$.

Of this contact area, an area contributing to the electric discharge is 48% from the result of the verification 3. Further, the sandpaper-like phenomenon disappearing current value is 97 (μA) from the result of the verification 3, and therefore the discharge current amount per unit area is 97 (μA)/(180.8 (mm)×0.48)=1.12 (μA/mm$^2$).

On the other hand, with respect to the charging rollers in Comparison Examples 1 to 10, it is understood from the verification 3 that the electric discharge little occurs in the contact portion. For this reason, a width of the discharge trace generated at each of upstream and downstream positions outside the contact portion was measured by using the ultra-deep color 3D profile measurement microscope (YK-9510) at the magnification of 5 for the objective lens. Further, an effective charging width of the charging members in Comparison Examples 1 to 10 is 226 mm. Incidentally, the applied bias is set so as to provide the sandpaper-like phenomenon disappearing discharge current amount for each of the charging rollers.

Similarly as in the case of this embodiment (First Embodiment), the discharge current amount per unit (discharge) area of each of the charging rollers in Comparison Examples 1 to 10 was calculated.

Further, the sandpaper-like phenomenon disappearing discharge current amount was obtained from the result of the verification 3, so that the discharge current amount per unit area in each of Comparison Examples 1 to 10 was calculated.

Figure 11:
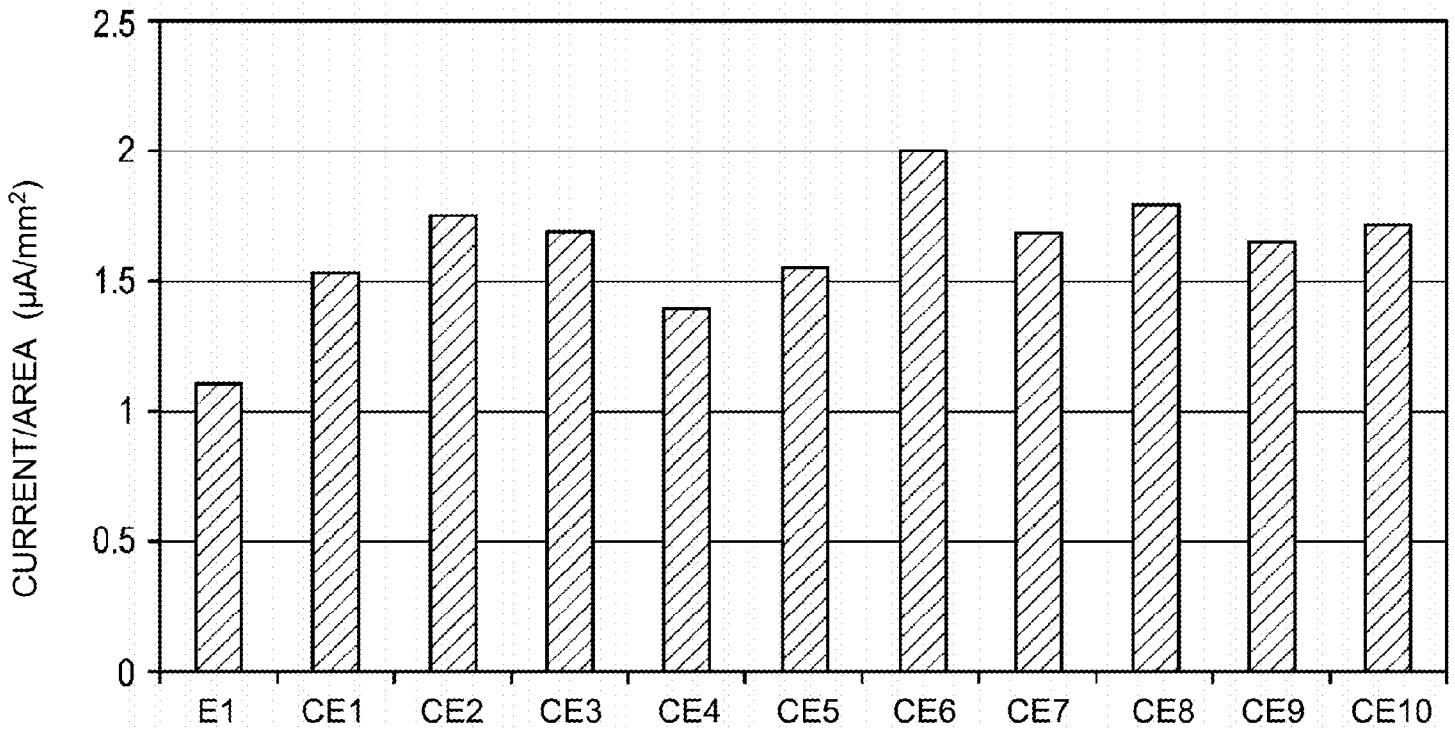
FIG. 11 is a graph showing a discharge amount per unit area of the charging roller in each of First Embodiment (Embodiment 1) and Comparison Examples 1 to 10.

FIG. 11 is a graph showing the discharge current amount per unit area in each of this embodiment ("E1") and Comparison Examples 1-10 ("CE1" to "CE10").

As shown in FIG. 11, it is understood that the discharge current amount per unit area of the charging roller 2 in this embodiment is suppressed to a low value.

This is because the discharge area of the charging roller 2 in this embodiment is larger than the discharge areas of the charging rollers in Comparison Examples 1 to 10, and therefore the discharge current amount per unit area can be lowered.

(Relationship Between Electric Discharge State and Cleaning Performance)

The present inventors have found that the features of the discharge state obtained from the results of the verifications 1 to 4 correlate with behavior at the contact portion of the cleaning blade 12 with the photosensitive drum 1 and smoothness of the photosensitive drum 1 during deterioration in a durability test. Further, the present inventors have found that the behavior at the contact portion of the cleaning blade 12 with the photosensitive drum 1 and the smoothness of the photosensitive drum 1 during deterioration in the durability test correlate with slip-through of the toner such that the toner slips through between the cleaning blade 12 and the photosensitive drum 1.

That is, in the case of this embodiment in which $L(1-P/ES)>7.7\times10^{-6}$ (m) is satisfied, the electric discharge can occur even in the contact nip which is the contact portion between the charging roller 2. That is, in the contact nip between the charging roller 2 and the photosensitive drum 1, there is an electrically dischargeable gap. For that reason, an electric discharge region is increased, so that it becomes possible to reduce the discharge current amount (discharge current density) per unit area compared with the conventional constitutions (Comparison Examples).

As a result, by the discharge between the charging roller 2 and the photosensitive drum 1, the surface of the photosensitive drum 1 is not readily roughened, so that a smooth state of the surface of the photosensitive drum 1 can be maintained for a long term. When the surface of the photosensitive drum 1 is smooth, a contact state between the cleaning blade 12 and the photosensitive drum 1 is also stabilized, with the result that even the polymerized toner which has high circularity in general can be removed stably by the cleaning blade 12.

That is, the spherical polymerized toner is high in transfer efficiency. During the transfer by the transfer roller 20, there is the action such that a proportion of the toner transferred from the photosensitive drum 1 is high and thus a proportion of the toner remaining on the photosensitive drum 1 is low. However, when the toner is spherical, there was a possibility that the toner slipped through between the photosensitive drum 1 and the cleaning blade 12 to cause improper cleaning (cleaning failure).

However, in this embodiment, it is possible to remove the polymerized toner having the average circularity of 0.97 with reliability and the present invention is also applicable to polymerized toners having the average circularity of 0.96 or more in general. That is, the cleaning blade 12 is capable of removing the polymerized toners having the average circularity of 0.96 or more from the surface of the photosensitive drum 1.

Incidentally, the average circularity was measured by a measuring device ("FPIA-3000", manufactured by Sysmex Corp.).

Particularly, in the case where the AC charging type in which the voltage in the form of the DC voltage biased (superposed) with the AC voltage is applied to the charging roller 2 to electrically charge the photosensitive drum 1 is employed, the discharge current amount from the charging roller 2 tends to increase and thus the discharge current density tends to increase.

Particularly, in Comparison Examples, the discharge does not occur in the contact nip between the charging roller 2 and the photosensitive drum 1, and therefore occurs only outside the contact nip. For that reason, local electric discharge narrow in discharge area occurs. As a result, the discharge current density becomes high.

As a result, particularly in the case where the AC charging type in which the voltage superposed with the AC voltage is applied to the charging roller 2 to charge the photosensitive drum 1 is employed, the surface of the photosensitive drum 1 is liable to be roughened. When the surface of the photosensitive drum 1 is roughened, the contact state of the cleaning blade 12 relative to the photosensitive drum 1 is not stabilized. With respect to the polymerized toner having a higher degree of the circularity than the pulverized toner, when the contact state between the cleaning blade 12 and the photosensitive drum 1 is not stabilized, the polymerized toner slips through between the cleaning blade 12 and the photosensitive drum 1. As a result, in Comparison Examples, it is difficult to scrape off the polymerized toner by the cleaning blade 12.

Figures 12, 13:
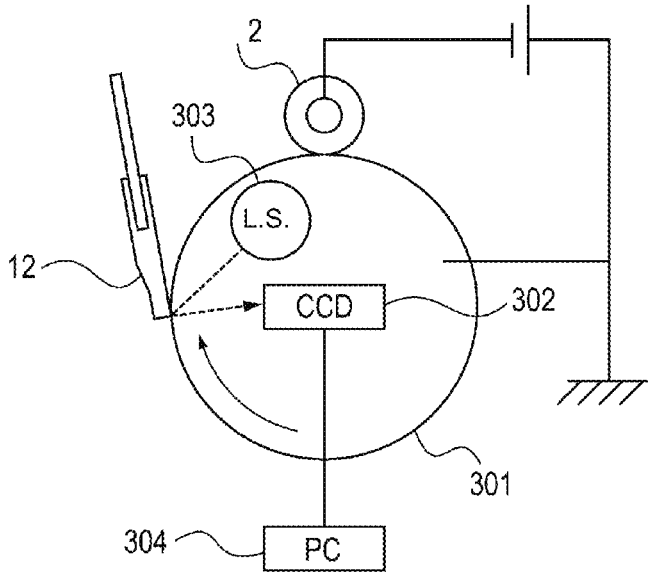
FIG. 12 is a graph showing states of the photosensitive drum at the time when printing of a predetermined number of sheets is made in each of First Embodiment (Embodiment 1) and Comparison Examples 1 to 3.
FIG. 13 is a schematic view showing a structure of a device for observing behavior of the cleaning blade with respect to a longitudinal direction in First Embodiment (Embodiment 1).

FIG. 12 is a table showing states of the photosensitive drum 1 at the time when an image of 1% in print ratio is printed (formed) on 9000 sheets in an environment of 15° C. and 10% RH in each of this embodiment ("EMB. 1") and Comparison Examples 1 to 3 ("COMP. EX. 1" to "COMP. EX. 3").

A drum abrasion speed ("ABRASION") is a value of abrasion per image formation of 1000 sheets (μm/k) of the photosensitive layer of the photosensitive drum 1.

The discharge current density ("CURRENT") is an amount (μA) of the current passing per unit area (1 mm$^2$).

With respect to a cleaning property ("CLEANING"), a good cleaning property is represented by "o", and a poor cleaning property is represented by "x".

A drum surface roughness ("ROUGHNESS") Ra (μm) is the surface roughness of the photosensitive drum 1. A larger value thereof shows a roughened state in a higher degree. In the table of FIG. 12, as the surface roughness, an arithmetic average roughness Ra defined in JIS B0601-1982 was used. As a surface roughness measuring machine, "Surfcoder SE3500" (manufactured by Kosaka Laboratory Ltd.) was used.

A measurement condition is 0.05 mm/sec in feeding speed, 0.8 mm in cut-off value, 2.5 mm in evaluation length and Gaussian filter as a filter used.

As is understood from FIG. 12, compared with Comparison Examples 1 to 3, in this embodiment, the abrasion speed is low, i.e., the photosensitive layer is not readily abraded, and therefore the surface of the photosensitive drum 1 maintains a smooth state in which the value of the drum surface roughness Ra is small. As a result, also the cleaning property (performance) is kept in a good state.

This is because as in the above-described verifications, with respect to the charging roller in this embodiment, the discharge current density is reduced.

That is, even when the AC charging type in which the high discharge current amount is obtained is used, the discharge current density can be suppressed at a low level, and therefore the drum maintains the smoothness and thus the cleaning property is improved, so that it is possible to use the polymerized toner which is not readily removed. That is, the polymerized toner is 0.96 or more in average circularity in general and thus a high in circularity, but can be removed with reliability.

That is, in this embodiment, both the AC charging type and the polymerized toner can be employed, and therefore it is possible to enhance the toner transfer efficiency while enhancing charging uniformity of the photosensitive drum 1.

Incidentally, the toner used in this embodiment has a particle size in a range of approximately 4-9 μm, and is 7 μm in average particle size. When the toner having the average particle size of about 4-9 μm in general is used, in this embodiment, the cleaning property can be improved compared with Comparison Examples.

In the following, results of verification experiments in this embodiment for investigating relations between the discharge state of the image forming apparatus and behavior of the cleaning blade and between the discharge state of the image forming apparatus and the drum smoothness will be described.

(Verification 5: Observation of Behavior with Respect to Longitudinal Direction)

FIG. 13 is a schematic view showing a structure of an apparatus for observing behavior of the cleaning blade 12 with respect to the longitudinal direction.

As shown in FIG. 13, onto a glass drum 301 having a diameter of 84 mm, an electroconductive film is applied, and thereon a charge transporting layer is applied, thus ensuring a chargeable state. Inside the glass drum 301, a CCD camera 302 (Model "DFK31BG03.H", manufactured by The Imaging Source Europe GmbH) and a light source ("L.S") 303 are provided, so that the contact state of the cleaning blade 12 can be observed from the inside of the glass drum 301.

Incidentally, an image captured by the CCD camera 302 is once stored in a personal computer 304. Thereafter, frame advance reproduction is made, so that behavior of the cleaning blade 12 changed locally can be observed.

In order to observe the change in behavior of the cleaning 1 with reliability, a peripheral speed of the glass drum 301 was set at 10 rpm, and a frame rate of the CCD camera 302 was set at 30 frames/sec.

In a state in which the glass drum 301 is charged by the charging roller 2, from the inside of the glass drum 301, the behavior of the cleaning blade 12 in the neighborhood of the nip and behavior of a preventing layer were observed.

Incidentally, a charging bias condition was set so that resultant discharge current amounts were the same. In this embodiment, the applied charging bias Vpp was 1.4 KV, and in Comparison Example 1, the applied charging bias was 1.6 KV.

Figure 14:
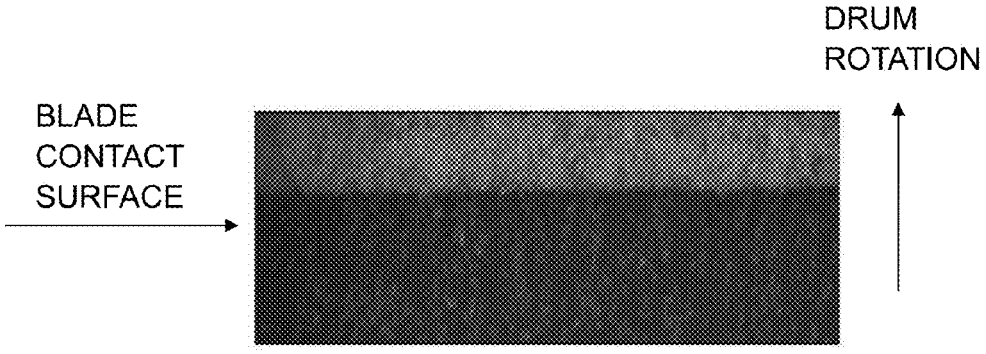
In FIG. 14, (*a*) and (*b*) are images each showing a contact state of the cleaning blade, in which (*a*) is the first showing the contact state of the cleaning blade in the case where the charging roller in First Embodiment (Embodiment 1) is used, and (*b*) is the first showing the contact state of the cleaning blade in the case where the charging roller in Comparison Example 1 is used.
Figure 14:
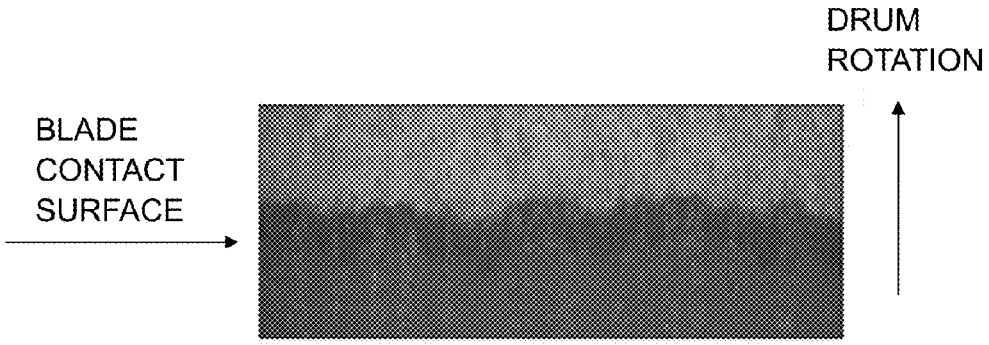

In FIG. 14, (*a*) and (*b*) are images showing contact states, in which (*a*) is the first showing the contact state of the cleaning blade 12 in the case where the charging roller 2 in this embodiment is used, and (*b*) is the image showing the contact state of the cleaning blade 12 in the case where the charging roller in Comparison Example 1 is used.

As shown in (*a*) of FIG. 12, in the case where the charging roller 2 in this embodiment, waviness with respect to the longitudinal direction is suppressed, so that no slip-through of the toner can be confirmed. Further, also during driving, it was similarly confirmed that the waviness with respect to the longitudinal direction was suppressed.

On the other hand, as shown in (*b*) of FIG. 14, in the case where the charging roller in Comparison Example 1 is used, a state in which the waviness with respect to the longitudinal direction generates and thus the slip-through of the toner locally occurs can be confirmed.

FIG. 15 is a table showing data in the case where the observation of the contact state of the cleaning blade 12 is performed also in other Comparison Examples 2 to 10 similarly as in the case of Comparison Example 1.

In the case where the photosensitive drum 1 is charged by the charging roller 2 in this embodiment, the preventing layer formed at the nip of the cleaning blade 12 is stably present with respect to the longitudinal direction.

On the other hand, in the case where the photosensitive drum 1 is charged by the charging roller in Comparison Example 1, the preventing layer is distorted so as to cause the waviness with respect to the longitudinal direction and thus is locally broken, so that the occurrence of the slip-through of the toner at the position can be confirmed. When a similar observation was performed also in Comparison Examples 2 to 10, the occurrence of the slip-through of the toner was confirmed.

In this way, it was clarified that the behavior of the cleaning blade 12 changed depending on a difference in discharge state of the charging rollers, particularly a difference in discharge current density.

That is, in Comparison Examples in which the discharge current density per unit area is high, the discharge phenomenon generates non-uniformly with respect to the longitudinal direction of the charging roller, and therefore there was the case where the behavior of the cleaning blade was non-uniform with respect to the longitudinal direction and thus the slip-through of the toner generated. On the other hand, in this embodiment, the discharge current density per unit area can be decreased, and therefore the discharge non-uniformity with respect to the longitudinal direction is not readily generated and thus the behavior of the cleaning blade can be stabilized.

(Verification 6: Actual Machine Evaluation)

The cleaning property was evaluated in the case where contact pressure of the cleaning blade 12 to the peripheral surface of the photosensitive drum 2 was set at two levels consisting of a high pressure and a low pressure. In the high-pressure setting, the contact pressure (linear pressure) of the cleaning blade 12 to the peripheral surface of the photosensitive drum 1 was 80 g/cm, and in the low-pressure setting, the contact pressure (linear pressure) was 40 g/cm. Further, a contact angle of the cleaning blade 12 was set at 24 degrees. Incidentally, the charging bias condition was set so that resultant discharge current amounts were the substantially same value. The applied charging bias Vpp was 1.4 KV in this embodiment and was 1.6 KV in Comparison Examples.

In an evaluation environment was 7.5° C. and 30% RH, a durability test of 15,000 sheets was conducted under a condition of two-sheet intermittent full-color image formation of a test image on letter-sized paper. The durability test was conducted at a print ratio of 1%, and during the durability test, samples and test images such as a half-tone image every 1,000 sheets are outputted, so that a defect on the outputted image was observed.

As shown in FIG. 15, with respect to the charging roller 2 in this embodiment, no toner slip-through was not generated, so that a very good result was obtained.

(Verification 7: Smoothness of Photosensitive Member)

Evaluation of damage generated on the photosensitive drum 1 by the charging roller was conducted in each of this embodiment and Comparison Examples. A cleaning device in which the associated charging roller was incorporated was prepared and then was subjected to the durability test of 15,000 sheets in an evaluation environment of 35° C./90% RH under the condition of the two-sheet intermittent full-color image formation of the test image on the letter-sized paper. In the durability test, the print ratio was 1%. The surface roughness of the photosensitive drum 1 at the time of passing of 1,500 sheets was measured. Incidentally, the charging bias condition was set so that resultant discharge current amounts were the substantially same value. The applied charging bias Vpp was 1.4 KV in this embodiment, and was 1.6 KV in Comparison Examples.

In the durability test, the contact pressure (linear pressure) of the cleaning blade 12 to the peripheral surface of the photosensitive drum 1 was set at 80 g/cm which was the high pressure. This is because the discharge current amount is increased with an increasing absolute water content and thus the high cleaning contact pressure is liable to generate the damage. For this reason, the durability test was conducted under an accelerated electric discharge environment.

Incidentally, measurement of Rzjis is based on JIS-B0601-2001, and was conducted by using a surface roughness measuring device ("Surfcoder SE3500", manufactured by Kosaka Laboratory Ltd.). Further, the measurement was made under a condition of 8.0 mm in measurement length, 0.8 mm in cut-off value and 0.3 mm/sec in measurement speed with respect to the longitudinal direction.

As shown in FIG. 15, the photosensitive drum 1 subjected to durability evaluation by using the charging roller 2 in this embodiment showed a tendency that Rz is low but Sm is large. Sm refers to an average distance (μm) between projections and recesses in the case where the photosensitive drum 1 is provided with the projections and the recesses.

That is, the drum smoothness after the durability test evaluation using the charging roller 2 in this embodiment is best.

(Verification 8: Cartridge Torque Lowering Ratio)

When the charging rollers in Comparison Examples 1-10 caused the toner slip-through, a cleaning blade contact pressure necessary to suppress the toner slip-through was checked, and then a cartridge torque at that time was measured.

When the toner slip-through occurred in the verification 6, the contact pressure (set angle and penetration depth (amount)) of the cleaning blade 12 was changed, and then setting of the cleaning blade 12 necessary to suppress the toner slip-through was made, and then in the setting, the cartridge torque was measured.

As shown in FIG. 15, "TORQUE" (%) is a ratio of each of the measured cartridge torque when the cartridge torque in this embodiment is 100%. In the case where the charging rollers in Comparison Examples 1-10 were used, in order to suppress the slip-through of the toner, compared with the cartridge torque in this embodiment, there was a need to provide the cartridge torques which were 120% to 200% of the cartridge torque in this embodiment.

From this result, the charging roller 2 in this embodiment can decrease the discharge current density to suppress the abrasion of the drum, and therefore compared with the conventional cartridges, it becomes possible to lower the cleaning blade contact pressure necessary to suppress the slip-through of the toner. As a result, it is understood that the cartridge torque (a torque necessary to drive the cartridge) can be reduced.

As described above, by using the charging roller 2 in this embodiment, compared with the conventional charging members, the discharge current amount is increased by enlargement of the discharge area, and therefore it is possible to use a low charging bias without causing the improper charging such as sandpaper-like fog. Further, with respect to the applied voltage at this time, the discharge current density can be suppressed to a low level, and therefore throughout a lifetime of a product, it becomes possible to suppress the abrasion of the photosensitive drum to maintain the smoothness. As a result, it becomes possible to stabilize the behavior of the rubber blade, and even when the spherical toner which is not readily removed in general is used, it is possible to prevent the occurrence of the slip-through of the toner while lowering the cartridge torque.

<Second Embodiment>

An image forming apparatus in another embodiment according to the present invention will be described. In this embodiment, a constitution of a cleaning blade 12 is different, and specifically the cleaning blade 12 subjected to hardening (curing) at a contact portion with the develop 1 is used. As a hardening method in this embodiment, a curable layer was formed by using a method in which after an elastic blade was impregnated with at least an isocyanate compound for a predetermined time without being impregnated with an active hydrogen compound, the isocyanate compound and polyurethane resin were caused to react with each other. In this way, by subjecting the cleaning blade 12 to the hardening, friction between the photosensitive drum 1 and the cleaning blade 12 is decreased, so that the behavior of the cleaning blade 12 can be stabilized. As another method, after the elastic blade is impregnated with a silicon-containing UV curable material and is swelled, the elastic blade is irradiated with UV ray, so that a cured layer is formed at the surface of the cleaning blade. Incidentally, the image forming process is the same as that in First Embodiment, and therefore will be omitted from redundant description.

(Verification 9: Correlation Between Smoothness and Slip-Through)

Evaluation of the cleaning property of the cleaning blade 12 subjected to the hardening in this embodiment with respect to photosensitive drums 1 different in surface roughness was conducted.

In an environment of 23° C./50% RH, the hardened cleaning blade 12, each of the charging rollers and the photosensitive drum 1 used in the verification 7 were incorporated into a cleaning device, and then the occurrence of the slip-through of the toner at the time of passing of 100 sheets was checked.

FIG. 16 is a table showing a state of the occurrence of the toner slip-through in each of this embodiment (Second Embodiment ("EMB. 2")) and Comparison Examples 1-10 ("COMP. EX. 1" to "COMP. EX. 10") in the case where the hardened cleaning blade 12 is used.

As shown in FIG. 16, it is understood that the hardened cleaning blade 12 causes no slip-through of the toner since the smoothness of the photosensitive drum 1 charged by the charging roller 2 in this embodiment is ensured.

(Verification 10: Actual Machine Evaluation)

The cleaning property was evaluated when the contact pressure of the hardened cleaning blade 12 to the peripheral surface of the photosensitive drum 1 was set at each of a high pressure and a low pressure. The contact pressure (linear pressure) of the cleaning blade 12 to the photosensitive drum 1 is 80 g/cm as the high pressure and is 40 g/cm as the low pressure. Further, the contact angle of the cleaning blade 12 was set at 24 degrees. Incidentally, the charging bias condition was set so that resultant discharge current amounts were the substantially same value. The applied charging bias Vpp was 1.4 KV in this embodiment and was 1.6 KV in Comparison Examples.

In an evaluation environment was 7.5° C. and 30% RH, a durability test of 15,000 sheets was conducted under a condition of two-sheet intermittent full-color image formation of a test image on letter-sized paper. The durability test was conducted at a print ratio of 1%, and during the durability test, samples and test images such as a half-tone image every 1,000 sheets are outputted, so that a defect on the outputted image was observed.

As shown in FIG. 16, also with respect to the hardened charging roller 2 as in this embodiment, the smoothness of the photosensitive drum 1 was ensured by the discharge current density decreasing effect by the charging roller in this embodiment, so that the cleaning blade 12 was stably contacted to the develop 1, and therefore a very good result was obtained.

<Other Embodiments>

In the charging type in First and Second Embodiments described above the AC charging bias (voltage) is applied, but the charging type is not limited to the AC charging type. Also in the DC charging type, similarly, the behavior of the cleaning blade 12 is stabilized.

Further, as the voltage control in the AC charging type, the applied voltage is variably changed so as to provide a constant discharge current value, but the voltage control is not limited thereto. Also constant-voltage control is suitably used.

Further, in First and Second Embodiments, as the waveform of the AC component of the oscillating voltage, the sine wave is applied, but the waveform is not limited thereto. For example, a voltage in the form of a rectangular wave, a saw-tooth wave, a triangular wave, or a rectangular wave formed by periodically turning on and off a DC voltage may also be applied.

Incidentally, in First and Second Embodiments, as the toner, the magnetic toner is used, but the toner is not limited thereto. For example, even when a non-magnetic toner is used, a similar effect can be obtained.

Further, in this embodiment, the jumping developing method is employed, but the developing method is not limited thereto. For example, even when a contact developing method is employed, a similar effect can be obtained.

Further, in the image forming apparatus in First and Second Embodiments, the toner image formed on the photosensitive drum 1 was directly transferred onto the recording medium 50. However, a constitution in which the toner image formed on the develop 1 is once transferred onto an intermediary transfer member and then is transferred from the intermediary transfer member onto the recording medium 50 may also be employed. That is, an object (transfer-receiving member) onto which the transfer roller 20 transfers the toner image may be the recording medium 50 or the intermediary transfer member.

Figure 17:
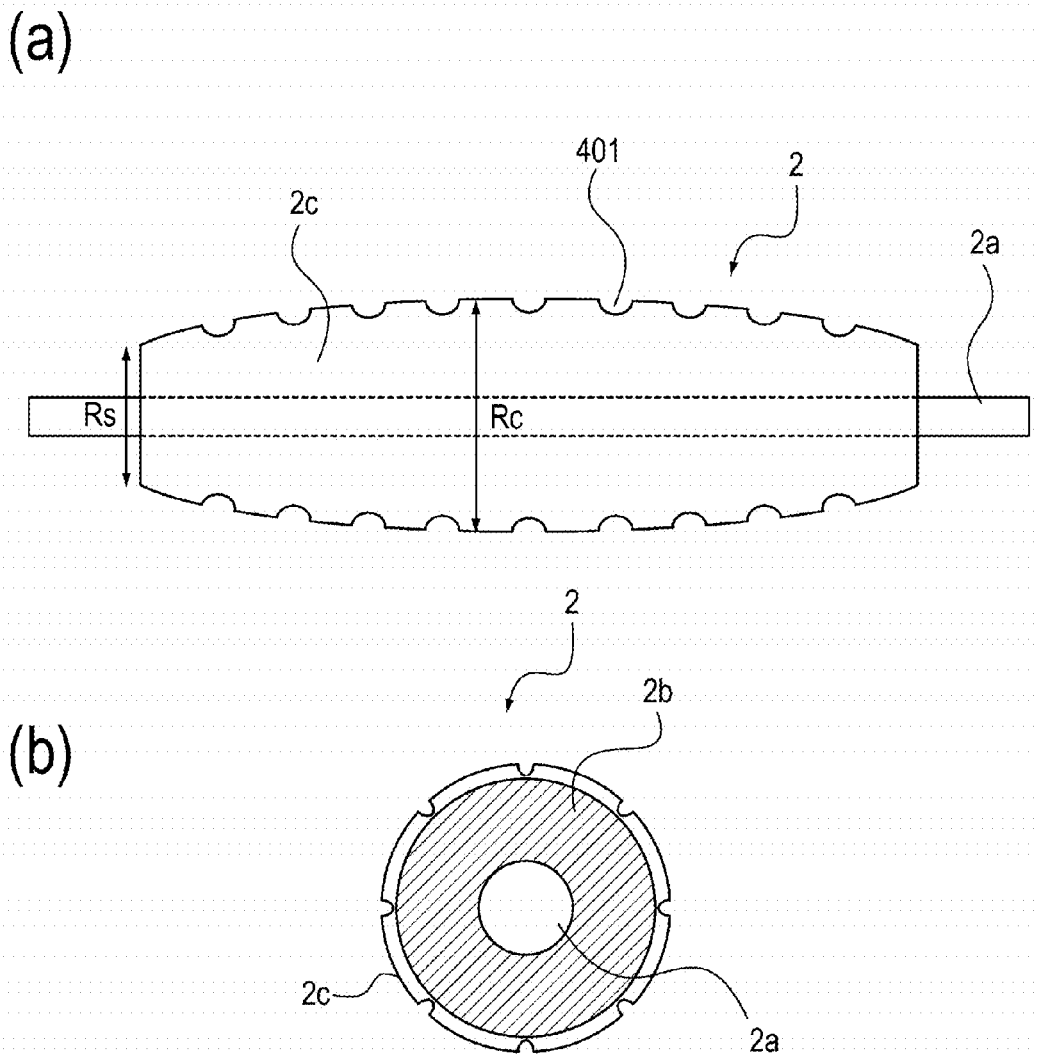
In FIG. 17, (*a*) is an illustration of a charging roller in a modified embodiment, and (*b*) is a sectional view of the charging roller in the modified embodiment.

In FIG. 17, (*a*) and (*b*) are schematic views showing a structure of the charging roller 2 as a modified embodiment. In FIG. 17, (*b*) is a sectional view of the charging roller 2. As shown in (*a*) of FIG. 17, a thickness of the charging roller 2 is different between at an end portion and at a central portion in the modified embodiment. In (*a*) of FIG. 17, an example of a crown shape such that the charging roller 2 is thinner at each of end portions than at the central portion is shown. Further, in the modified embodiment, the surface layer 2*c* of the charging roller 2 is provided with a plurality of minute recessed portions 401 by etching or the like. As a result, by the plurality of the recessed portions 401, the surface of the charging roller 2 is provided with projections and recesses. The single projection is constituted by adjacent two recessed portions 401. The projections are contacted to the develop 1 to leave dischargeable gaps between the develop 1 and the charging roller 2 while being elastically deformed.

That is, when the surface of the charging roller 2 is capable of being provided with the projections and the recesses, a plurality of projected portions (minute projections 201) may be provided at the surface of the charging roller 2, and the plurality of recessed portions 401 may also be provided at the surface of the charging roller 2. Further, the thickness (diameter) of the charging roller 2 may also be different between at the central portion and at the end portion.

(Effects of First and Second Embodiments)

Effects of First and Second Embodiments are summarized as follows.

According to the charging member (charging roller 2) in each of First and Second Embodiments, by the projected portions formed at the surface of the elastic surface layer, when the charging bias is applied in the elastically deformed state of the surface layer, the dischargeable gaps are formed in a region where the charging member is press-contacted to the image bearing member (photosensitive drum).

For this reason, the dischargeable area is increased, and therefore the discharge current amount per unit area can be reduced.

As a result, by uniform electric discharge between the charging member and the image bearing member, the surface of the image bearing member is not readily roughened, so that it is possible to maintain the smooth state of the surface of the image bearing member for a long term. When the surface of the image bearing member is smooth, the contact state between the cleaning blade and the image bearing member is stabilized, so that it is possible to remove even the polymerized toner, having the high degree of the circularity in general, without causing the slip-through of the toner.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 145136/2013 filed Jul. 11, 2013, which is hereby incorporated by reference.

What is claimed is:

1. A process cartridge detachably mountable to an image forming apparatus, said process cartridge comprising:

an image bearing member for forming a latent image;

a charging member, press-contacted to said image bearing member at a predetermined urging force, for electrically charging said image bearing member by being supplied with a charging bias;

developing means for developing the latent image by supplying a polymerized toner to said image bearing member; and a cleaning blade for removing the polymerized toner deposited on said image bearing member in contact with said image bearing member, wherein said charging member comprises:

an electroconductive support;

one or more elastic layer formed around said electroconductive support; and projected portions and recessed portions provided on a surface of said charging member, wherein said projected portions are elastically deformable in contact with said image forming member, leaving electrically dischargeable gaps between said recessed portions of said charging member and said image bearing member, and wherein, when a potential difference between said charging member and said image bearing member is V in volts, an urging force for urging said charging member to said image bearing member is P in Newtons, a height of said projected portions before elastic deformation is L in meters, the sum of areas of contact portions where said projected portions contact said image bearing member is S in square meters, and Young's modulus when said elastic layer is deformed is E in megapascals, these parameters satisfy the following relationship:

$$(V-312)/6.2\times10^{-6}>L(1-P/ES)>7.7\times10^{-6}.$$

2. A process cartridge according to claim 1, wherein the charging bias superposes a process cartridge voltage with an AC voltage.

3. A process cartridge according to claim 1, wherein said projected portions are formed by incorporating particles into said elastic layer.

4. A process cartridge according to claim 1, wherein the polymerized toner is spherical and is 4-9 μm in average particle size.

5. A process cartridge according to claim 1, wherein the polymerized toner has an average circularity of 0.96 or more.

6. A process cartridge according to claim 1, wherein a portion of said cleaning blade in contact with said image bearing member is oxidized.

7. A process cartridge according to claim 1, wherein a surface portion of said image bearing member is an organic photosensitive member.

8. A process cartridge according to claim 1, wherein said charging member includes, as said elastic layer, an electroconductive elastic layer and an electroconductive surface layer, provided on a surface of said electroconductive elastic layer, which is harder and thinner than said electroconductive elastic layer.

9. A process cartridge according to claim 1, wherein said charging member has a ten-point average roughness Rz of 15-50 μm at the surface thereof.

10. A process cartridge according to claim 1, wherein said charging member has MD-1 hardness of 60-85 degrees at the surface thereof.

11. An image forming apparatus for forming an image on a recording medium by using a polymerized toner, said image forming apparatus comprising:

an image bearing member for forming a latent image;

a charging member, press-contacted to said image bearing member at a predetermined urging force, for electrically charging said image bearing member by being supplied with a charging bias;

a developing device for developing the latent image by supplying a polymerized toner to said image bearing member;

a transfer device for transferring a toner image, formed on said image bearing member, onto a transfer-receiving member; and a cleaning blade for removing the polymerized toner deposited on said image bearing member in contact with said image bearing member, wherein said charging member comprises:

an electroconductive support;

one or more elastic layer formed around said electroconductive support; and projected portions and recessed portions provided on a surface of said charging member, wherein said projected portions are elastically deformable in contact with said image bearing member, leaving electrically dischargeable gaps between said recessed portions of said charging member and said image bearing member, and wherein, when a potential difference between said charging member and said image bearing member is V in volts, an urging force for urging said charging member to said image bearing member is P in Newtons, a height of said projected portions before elastic deformation is L in meters, the sum of areas of contact portions where said projected portions contact said image bearing member is S in square meters, and Young's modulus when said elastic layer is deformed is E in megapascals, these parameters satisfy the following relationship:

$$(V-312)/6.2\times10^{-6}>L(1-P/ES)>7.7\times10^{-6}.$$

12. An image forming apparatus according to claim 11, wherein the charging bias superposes a process cartridge voltage with an AC voltage.

13. An image forming apparatus according to claim 11, wherein said projected portions are formed by incorporating particles into said elastic layer.

14. An image forming apparatus according to claim 11, wherein the polymerized toner is spherical and is 4-9 μm in average particle size.

15. An image forming apparatus according to claim 11, wherein the polymerized toner has an average circularity of 0.96 or more.

16. An image forming apparatus according to claim 11, wherein a portion of said cleaning blade in contact with said image bearing member is oxidized.

17. An image forming apparatus according to claim 11, wherein a surface portion of said image bearing member is an organic photosensitive member.

18. An image forming apparatus according to claim 11, wherein said charging member includes, as said elastic layer, an electroconductive elastic layer and an electroconductive surface layer, provided on a surface of said electroconductive elastic layer, which is harder and thinner than said electroconductive elastic layer.

* * * * *